United States Patent [19]

Nordlof

[11] Patent Number: 4,555,071

[45] Date of Patent: Nov. 26, 1985

[54] STOCK REEL DANCER

[76] Inventor: Richard D. Nordlof, 3312 Crest Rd., Rockford, Ill. 61107

[21] Appl. No.: 666,502

[22] Filed: Oct. 30, 1984

[51] Int. Cl.[4] ..... B65H 75/02; B65H 59/38

[52] U.S. Cl. ..... 242/75.5; 242/105

[58] Field of Search ..... 242/189, 190, 75.3, 242/75.5, 75.51, 105; 226/44; 200/61.13, 61.18

[56] References Cited

U.S. PATENT DOCUMENTS 1,882,578 10/1932 Hardiman ..... 242/75.3

3,162,394 12/1964 Culpepper et al. ..... 242/105

*Primary Examiner*—Stuart S. Levy

*Assistant Examiner*—Lloyd D. Doigan

*Attorney, Agent, or Firm*—Vernon J. Pillote

[57] ABSTRACT

A stock reel for winding and unwinding stock from a coil under the control of a swingably mounted dancer arm. The stock reel has a reversible electric DC drive motor and a dancer arm switch is operated from a cam that rotates with the dancer arm. The operating angle of the dancer arm is adjusted by adjusting the angular position of the dancer arm switch. Visual indicator means are provided to indicate the adjusted position of the dancer arm switch and hence the operating angle of the dancer arm.

11 Claims, 9 Drawing Figures

STOCK REEL DANCER

BACKGROUND OF THE INVENTION

The present invention relates to power operated stock reels of the type having a swingably mounted dancer arm for sensing the size of the stock loop and for controlling operation of an electric reel drive motor. In such power operated stock reels, it is desirable that the operating angle of the dancer arm be adjustable. It is also desirable that the stock reel be adapted for operation with the dancer arm at either side of the reel, and that the stock reel be capable of either paying out or rewinding stock from either the top or the bottom of the reel.

In the prior art stock reels known to the applicant, a cam on the dancer arm pivot shaft was arranged to operate a dancer arm switch at a preselected angular position of the shaft, and the dancer arm was connected to the shaft so that the dancer arm could be angularly adjusted relative to the shaft and to the cam to change the operating angle of the dancer arm. It required considerable skill to change the operating angle by angularly adjusting the dancer arm relative to the dancer arm shaft. The operator had to apply a tool to the dancer arm pivot shaft; loosen the connection of the dancer arm to the front shaft; manipulate the tool to angularly position and hold the pivot shaft in the angular position at which the cam on the pivot shaft would actuate the switch; position and hold the dancer arm at the desired operating angle, and thereafter re-tighten the connection of the dancer arm to the shaft while holding both in the proper positions. In order to change the stock reel from operation with the dancer arm at one side of the reel to operation of the dancer arm at the other side of the reel, it was necessary to disassemble the dancer arm from its shaft and reassemble it with the dancer arm positioned at the other side of the reel, and to readjust the angular position of the dancer arm relative to the shaft in the manner previously described to positions that would be appropriate for the operation at that side of the reel. The prior art stock reels had a dancer arm function switch that was connected to the dancer arm switch to adapt the stock reel for payout and rewind operation, and a separate motor rotation control switch to enable reversing the direction of rotation of the reel drive motor as required in different payout and rewind operations at different sides of the stock reel. The prior art motor speed controls also commonly employed a speed control potentiometer to vary the speed of the reel drive motor and some of the motor controls included a selectively adjustable acceleration control to adjust the rate of acceleration of the reel.

SUMMARY OF THE INVENTION

It is an object of the present invention to provide a stock reel of the type having an electric reel drive motor and a dancer arm for controlling operation of the drive motor in accordance with the loop of stock extending from the reel, and in which the operating angle of the dancer arm can be easily and accurately adjusted.

Accordingly, the present invention provides a stock reel having an electric reel drive motor and a dancer arm mounted for swinging movement about a dancer arm axis and adapted to engage a loop of stock to be angularly displaced thereby. A motor control means is connected to reel drive motor and has an input signal controller operative to actuate the reel drive motor in response to a preselected input signal from the input controller, and a rotary actuator means is mounted for turning with the dancer arm about the dancer arm axis and is operative to control the input signal produced by the input signal controller in accordance with the relative angular position of the input controller and the rotary actuator. The input signal controller is mounted for angular adjustment relative to the reel support about the dancer arm axis to vary the angular position of the dancer arm at which the input signal controller produces an input signal to actuate the motor, to thereby vary the dancer arm operating angle.

The dancer arm can be selectively positioned at either side of the stock reel and the input signal controller is mounted for adjustment through a first range of positions to adjust the operating angle of the dancer arm when it is at one side of the stock reel and through a second range of positions to adjust the operating angle of the dancer arm when it is at the other side of the stock reel. The stock reel includes visual indicator means movable with the input controller to indicate the operating angle of the dancer arm.

Figure 1:
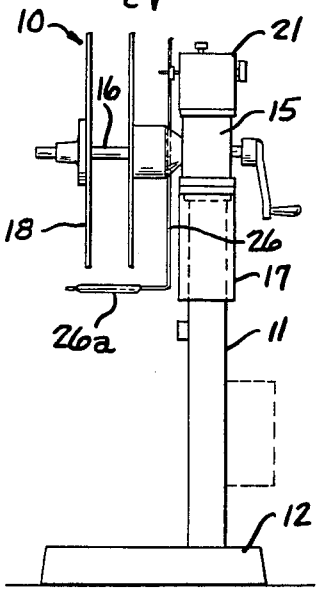
FIG. 1 is a side elevational view of a stock reel embodying the present invention.
Figure 2:
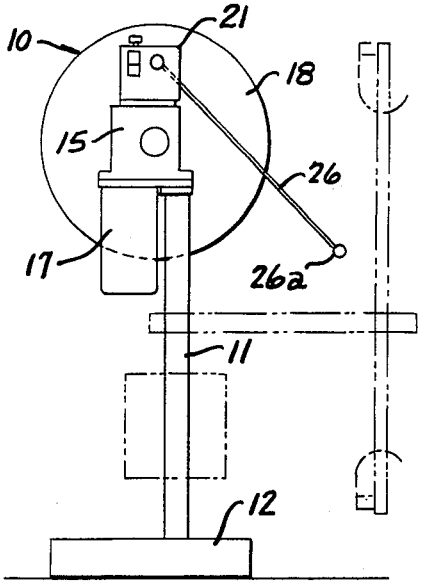
FIG. 2 is a front view of the stock reel of FIG. 1.

The stock reel 10 is adapted to payout or rewind stock at either side of the stock reel, and from either the top or bottom of the coil, to supply stock to or receive stock from a stock processing machine or apparatus (not shown) that performs some operation on the stock. The stock reel 10 is preferably self-supporting so that it can be moved into positions at the inlet or outlet side of the processing machine and, as shown in FIGS. 1 and 2, it is mounted on the upper end of a post 11 having a floor engaging base 12. The stock reel includes a drive head 15 mounted on the upper end of the post and a generally horizontal reel support shaft 16 that is rotatably supported in the drive head. The reel support shaft is reversibly driven by a reversible electric drive motor 17 attached to the drive head and the motor output shaft is connected through gearing (not shown) in the head to the reel drive shaft to rotate the same. A coil support 18, of any conventional construction suitable for supporting a coil stock, is mounted on the reel support shaft 16 for rotation therewith.

A control box 21 is mounted on the top of the drive head 15 and includes spaced side walls **21*a*, 21*b*, end walls 21*c* and 21*d*, and top and bottom walls 21*e* and 21*f***.

Figure 3:
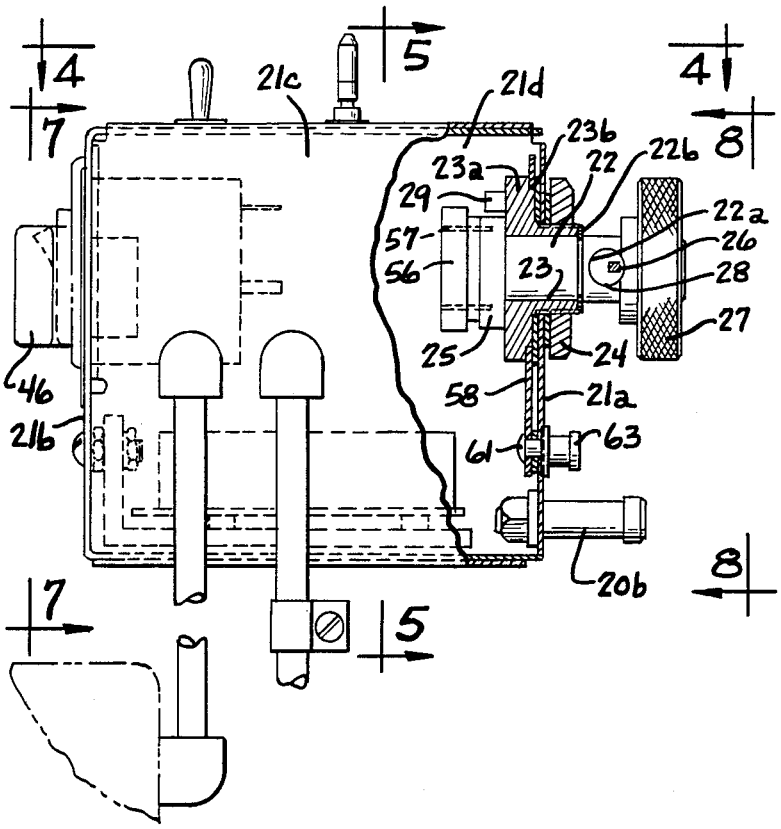
FIG. 3 is an enlarged view of the control unit for the stock reel, with parts broken away and shown in section to illustrate details of construction.
Figure 5:
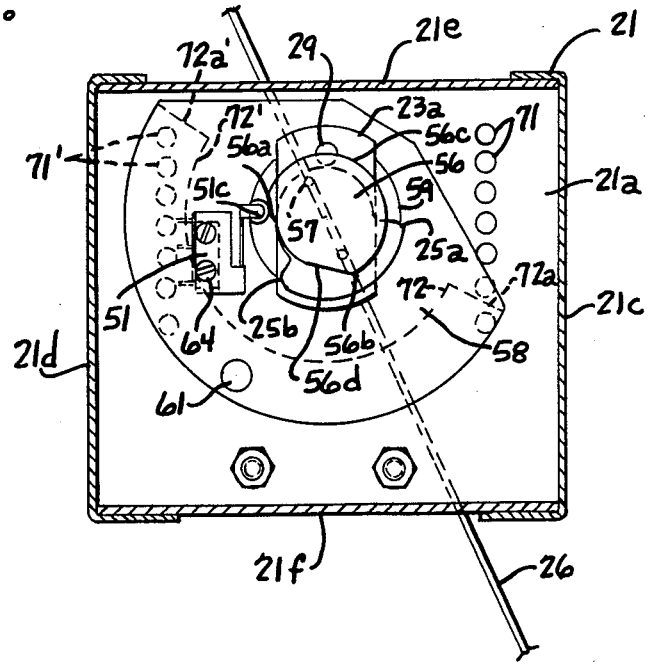
FIG. 5 is a fragmentary sectional view taken on the plane 5—5 of FIG. 3 with the dancer arm arranged to operate at one side of the stock reel.
Figure 6:
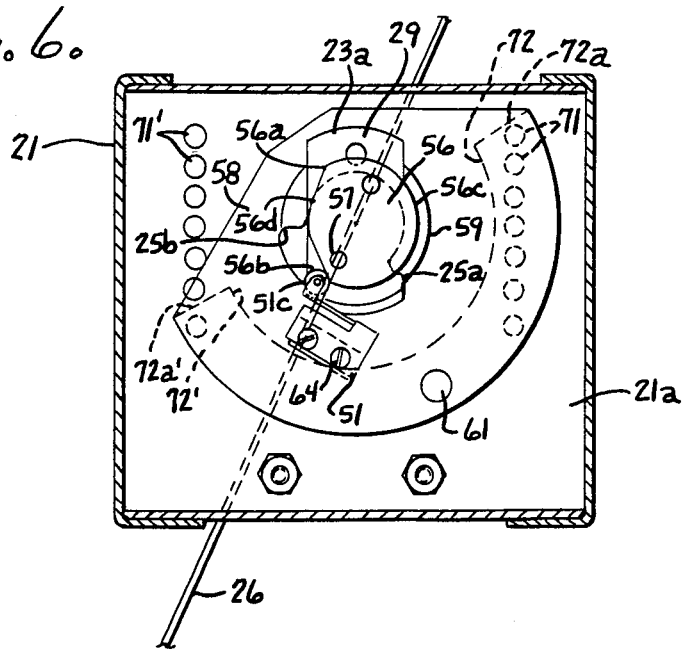
FIG. 6 is a fragmentary sectional view taken on the plane 5—5 of FIG. 3 with the dancer arm arranged to operate at the other side of the stock reel.
Figure 7:
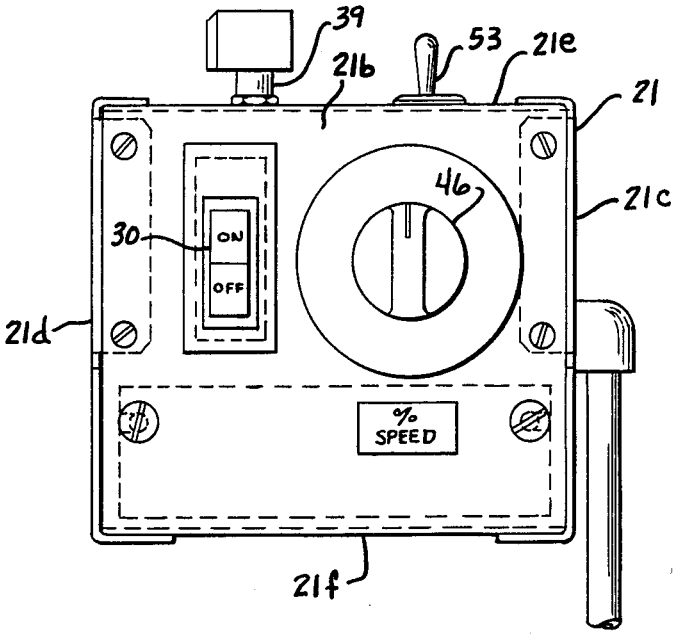
FIG. 7 is a front view of the stock reel control.
Figure 8:
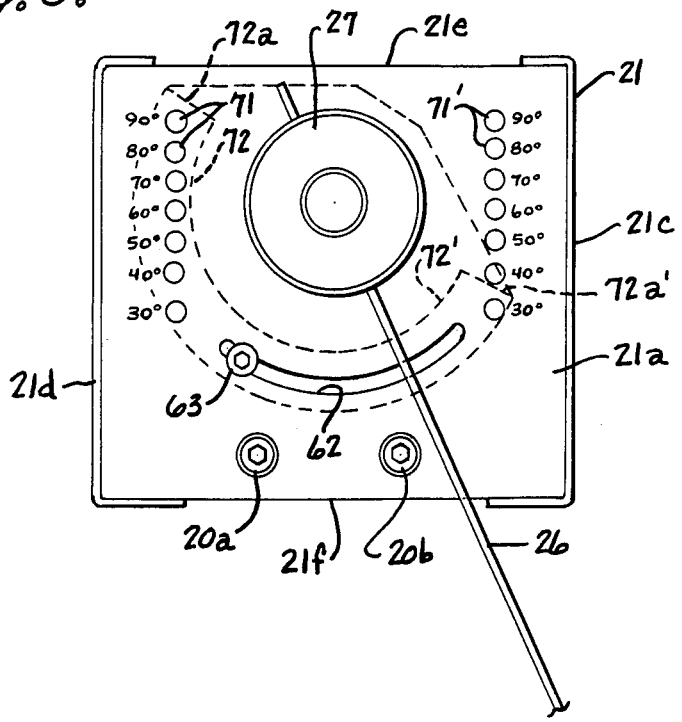
FIG. 8 is a view taken on the plane 8—8 of FIG. 3.

A dancer arm pivot shaft 22 is rotatably mounted in a bushing 23 that extends through an opening in the side wall 21*a*. The bushing has a flange 23*a* at the inner side of the wall 21*a*, and the flanged bushing is non-rotatably clamped to the wall by a nut 24 threaded on the bushing. As best shown in FIG. 3, the dancer arm shaft 22 is constrained against axial movement by a flange 25 at its inner end that engages the inner side of the flange 23*a* on the bushing, and by a split ring 22*b* disposed in a groove in the dancer arm shaft and which engages the outer end of the bushing. The dancer arm shaft 22 has a transverse bore 22*a* in the portion located outwardly of the bushing for slidably and non-rotatably receiving the the dancer arm 26, and a thumb wheel 27 is threaded on the outer end of the shaft to engage the dancer arm and lock the same in a selected longitudinally adjusted position. In order to accommodate both light weight low inertia dancer arms as well as heavier counterbalanced dancer arms, the opening 22*a* for receiving the dancer arm is made sufficiently large to receive the heavier arms, and a bushing 28 is provided to adapt the unit for light weight low inertia dancer arms. The dancer arm has a laterally extending stock engaging portion 26*a* at its outer end and, commonly, the stock engaging portion is in the form of a small diameter roller that extends crosswise of the path of the stock as it enters or exits from the stock reel. The dancer arm is thus moved angularly about its pivot shaft 22 through a range of dancer arm positions as the stock loop increases and decreases in size. In order to permit payout and rewind from either side of the stock reel, the dancer arm is arranged so that it can be selectively positioned at one side of the stock reel as shown in FIGS. 2 and 5 and also at the other side of the stock reel as shown in FIG. 6. As shown in FIGS. 1 and 2, the dancer arm pivot shaft is located above the reel support shaft and dancer arm stops 20*a* and 20*b* (FIG. 8) are provided on the side wall 21*a* of the control box to limit downward movement of the dancer arm. The dancer arm 26 can be adjusted lengthwise relative to the dancer arm shaft to change the effective length of the dancer arm while maintaining the dancer arm in fixed angular relation to the dancer arm shaft. In order to assure that the dancer arm can be installed in only one angular position on the dancer arm shaft when positioned at either side of the stock reel, the flange 25 on the dancer arm shaft is provided with stop shoulders 25*a*, 25*b* that are arranged to engage a stop pin 29 on the bushing flange 23*a*. The stop shoulders 25*a*, 25*b* are angularly spaced apart a distance to allow the dancer arm to move through its full range of dancer arm positions when positioned at either side of the stock reel.

Figure 9:
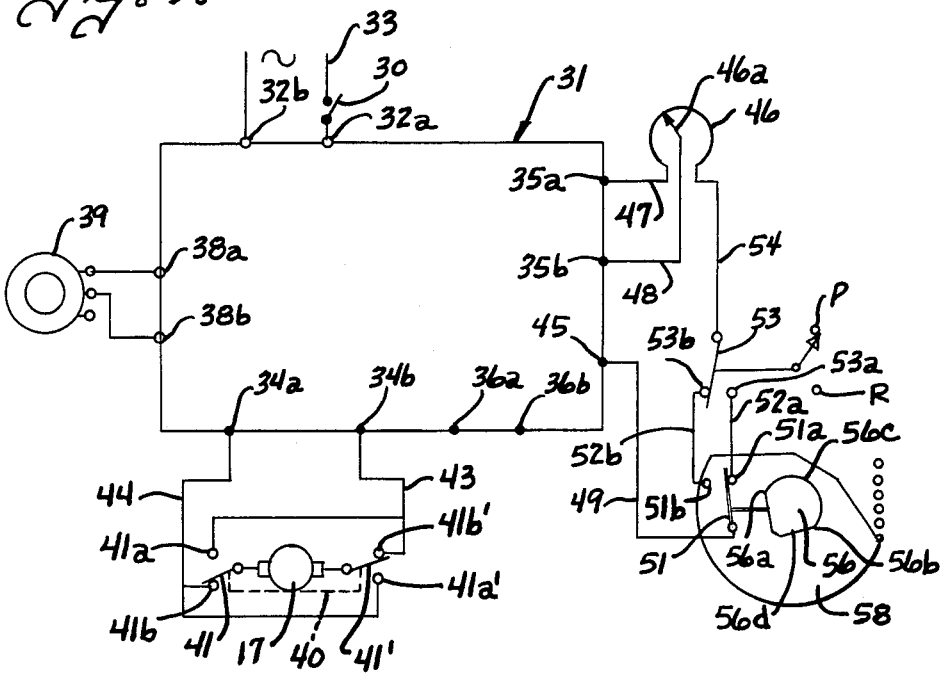
FIG. 9 is a schematic diagram of the control circuit for the stock reel.

The reel drive motor 17 is a reversible electric drive motor to enable rotation of the reel in either direction and is preferably a DC electric motor that can be reversibly operated on direct current such as a permanent-magnet motor or a shunt wound DC motor. A DC motor speed control 31 is provided for the motor 17 and as schematically shown in FIG. 9, the DC motor speed control has power supply terminals 32*a*, 32*b* arranged to be connected through a power switch 30 and conductors 33 to a source of power, such as an AC power line, and output terminals 34*a*, 34*b* arranged to be connected to the reversible DC motor 17. The DC motor speed control also has input terminals as 35*a*, 35*b* and the motor speed control is arranged to produce an output voltage at output terminals 34*a*, 34*b* that is correlative in amplitude with the amplitude of the input signal applied to the input terminals. DC motor speed controls suitable for use in controlling operation of fractional horsepower DC motors used for driving the stock reel are well known and commercially available from various different manufacturers. The motor speed control may, for example, be of the type sold by KB Electronics Inc. of Brooklyn, N.Y. under the tradename KBIC Solid State DC Motor speed control. Such motor speed controls can be used with either permanent-magnet or shunt wound DC motors, with armature output terminals 34*a* and 34*b* arranged for connection to the armature of the motor and field output terminals 36*a* and 36*b* arranged for connection to the field of a shunt motor. In the embodiment illustrated in FIG. 9, motor 17 is of permanent-magnet type and the field terminals 36*a* and 36*b* of the motor control 31 are not used. Such motor speed controls are also available with a controlled acceleration circuit to control the rate of acceleration of the drive motor. Such controlled acceleration circuit can include an adjustable potentiometer 39 which, as shown in FIG. 9, is connected to the controlled acceleration circuitry in the motor control circuit through terminals 38*a* and 38*b* to provide a selectively variable motor acceleration control. The controlled acceleration circuit operates each time the input signal applied to terminal 35*b* is increased and the potentiometer 39 can be utilized to adjust the acceleration rate of the reel drive motor. The voltage at the output terminals 34*a* and 34*b* of the DC motor control varies in amplitude with the amplitude of the signal applied to the input terminals 35*a*, 35*b*, but does not change polarity. A polarity reversing switch 40 is provided for reversing the polarity of the voltage applied to the armature of the motor 17 and, as diagrammatically shown in FIG. 9, the polarity reversing switch includes switch members 41, 41′ connected to the armature of the motor and respectively movable from a position engaging contacts 41*b*, 41*b*′ to a position engaging contacts 41*a*, 41*a*′. Contacts 41*a* and 41*b*′ are connected through conductors 43 to the output terminal 34*b*, and contacts 41*b*, 41*a*′ are connected through conductors 44 to the output terminal 34*a*. Details of the circuitry used in such commercially available DC motor speed controls forms no part of the present invention and further description is deemed unnecessary.

The input signal control circuit includes a manually adjustable speed control potentiometer 46 having one side connected through a conductor 47 to the negative input terminal 35*a* of the motor speed control and the wiper 46*a* of the potentiometer connected through a conductor 48 to the positive input terminal 35*b* of the motor control circuit. The DC motor speed control 31 is arranged to provide a constant DC supply voltage such as twelve volts positive to a terminal 45 and, as shown in FIG. 9, the terminal 45 is connected through a conductor 49 to a dancer arm switch 51. Dancer arm switch 51 is a two-position switch and is movable between a position engaging contact 51*a* to a position engaging contact 51*b*. Contacts 51*a* and 51*b* are respectively connected by conductors 52*a* and 52*b* to contacts 53*a*, 53*b* of a two-position payout-rewind switch 53, and switch 53 is connected through conductor 54 to the other terminal of the speed control potentiometer 46. Thus, voltage is supplied to the speed control potentiometer 46 under the control of the dancer arm switch 51 and payout-rewind switch 53, and the speed control potentiometer 46 is adjustable to control the amplitude of voltage or input signal applied to the input terminal 35*b*.

Figure 4:
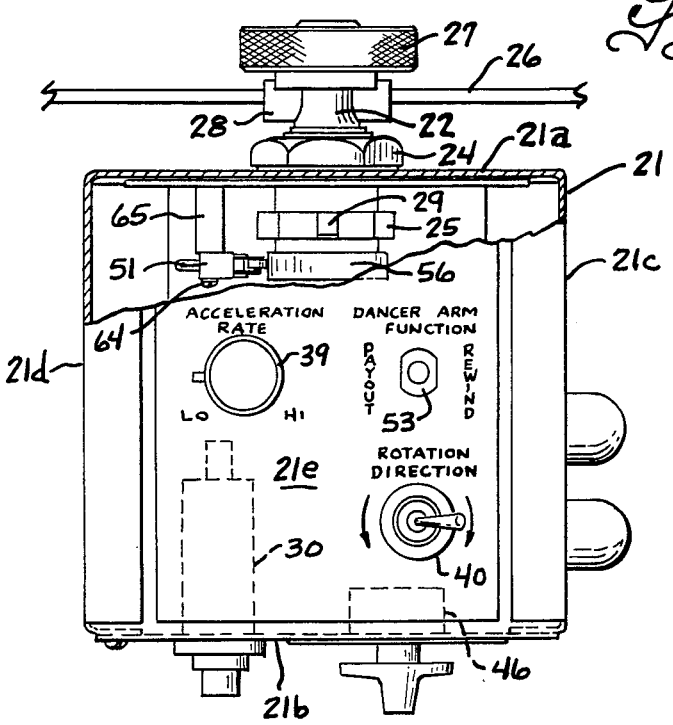
FIG. 4 is a top view of the control unit taken on the plane 4—4 of FIG. 3 and with parts broken away and shown in section to illustrate details of construction.

Dancer arm switch 51 is operated from a cam 56 that is mounted for rotation with the dancer arm shaft 22. As best shown in FIG. 3, cam 56 is secured as by fasteners 57 to the flange 25 on the dancer arm shaft. In accordance with the present invention, the operating angle of the dancer arm is made adjustable by adjusting the dancer arm switch 51 relative to the dancer arm cam. As best shown in FIGS. 2, 5 and 6, a sector plate 58 is provided with a circular opening 59 that is rotatably supported in arcuate recesses or notches 23*b* in the flange 23*a* of bushing 23. The sector plate is thus supported for angular adjustment relative to the control unit casing about an axis concentric with the dancer arm and axis. The sector plate is angularly adjustable from externally of the housing and, for this purpose, a screw 61 is secured to the sector plate and extends through an arcuate slot 62 (FIG. 8) in the side wall 21*a* of the control box, and has a clamp nut 63 on its outer end. The dancer arm switch 51 is mounted as by fasteners 64 and a bracket 65 (FIG. 4) on the sector plate 58, for angular adjustment with the sector plate.

The dancer arm 26 is positionable at either side of the stock reel and the dancer arm cam 56 has a first lobe 56*a* which is arranged to engage the actuator 51*c* on the dancer arm switch, when the dancer arm moves through a range of positions at one side of the stock coil, and a second lobe 56*b* that is arranged to engage the actuator of the dancer arm switch, as the dancer arm moves to a range of positions at the other side of the stock reel. The cam 56 has a circular dwell portion 56*c* with a radius the same as the apex of the lobes, and a second portion 56*d* that is disposed radially inwardly of the apex of the lobes. The switch 51 is normally biased to one condition or position engaging the contact 51*a* and the recessed portion 56*d* of the cam is arranged to allow the switch to move into its first condition when the portion 56*d* is adjacent the switch actuator 51*c*. The lobe 56*a* is arranged so that, when the dancer arm is at one side of the stock reel, and is rotated in one direction; namely, counterclockwise as viewed in FIG. 5, through a preselected angular position relative to the actuator, it will operate the switch 51 from a first condition engaging contact 51*a* to a second position engaging contact 51*b*. Lobe 56*b* is arranged so that, when the dancer arm is at the other side of the stock reel as shown in FIG. 6, it will engage the switch actuator 51*c* and move the switch from a first condition engaging contact 51*a* to a second condition engaging contact 51*b*, when the dancer arm is rotated in the opposite direction; namely, clockwise as viewed in FIG. 6 through a preselected angular position relative to the actuator. The dwell portion 56*c* of the cam is arranged to maintain the switch in its second condition in all of the dancer arm positions in which that portion of the cam engages the switch actuator. The angular position at which the lobe 56*a* engages the switch actuator to operate the switch when the dancer arm is at one side of the stock reel, and the angular position at which the lobe 56*b* engages the switch actuator to actuate the switch when the dancer arm is at the other side of the stock reel, defines the operating angle of the dancer arm, viz. the approximate angle of the dancer arm at which it actuates the switch to operate the reel drive motor. It is desirable to adjust the operating angle of the dancer arm to control the size of the loop and the tension maintained on the stock in the loop, to accommodate different types and thickness of the coil stock material. The operating angle of the dancer arm is preferably made adjustable from an angle of about 30° to the vertical to an angle of about 90° to the vertical. The dancer arm is shown in FIG. 5 positioned at one side of the stock reel and the sector plate 58 is angularly adjusted to a position in which the switch actuator 51*c* will be actuated when the dancer arm is about 30° from the vertical. Angular adjustment of the sector plate in a counterclockwise direction from the position shown in FIG. 5, will cause the switch actuator 51*c* to be engaged by the lobe 56*a* when the dancer arm is at a greater angle to the vertical so that the dancer arm operating angle is increased. In FIG. 6, the dancer arm is shown positioned at the other side of the stock reel and the dancer arm switch is positioned to be actuated by the lobe 56*b* on the cam when the dancer arm is at an angle of about 30° to the vertical. The sector plate can be angularly adjusted in a clockwise direction from the FIG. 6 position to increase the operating angle of the dancer arm. With the described arrangement in which the operating angle of the dancer arm is adjustable through a range of about 60° at each side of the stock reel, the lobes 56*a*, 56*b* are angularly spaced apart approximately 120° measured across the radially relieved portion 56*d* of the cam.

Visual indicator means are provided to indicate the operating angle of the dancer arm. While the sector plate adjusting knob 63 does move with the sector plate and dancer arm switch and would provide an indication of the operating angle, it is preferable to provide one visual indicator means to indicate the operating angle when the dancer arm is at one side of the stock reel and a second visual indicator means for indicating the dancer arm operating angle when the dancer arm is at the other side of the stock reel. In the embodiment shown, the visual indicator means includes a first row of openings designated 71 in the side wall 21*a* of the casing and spaced from one side of the pivot axis, and the second indicator means includes a second row of openings 71' in the front wall of the casing and spaced from the other side of the dancer arm axis. The openings 71 and 71' are arranged to enable viewing of the angular position of the sector plate and, in order to facilitate visual observation of the sector plate, arcuate bands 72 and 72' of a highly reflective paint or tape are provided on the side of the sector plate opposite the openings. The end edges 72*a*, 72*a'* of the colored bands are located at a preselected angular relation to the actuator 51*c* on the dancer arm switch such that the bands will extend across that one of the respective openings 71, 71' that indicates the approximate angle of the dancer arm at which the dancer arm cam operates the switch, to thereby indicate the approximate operating angle of the dancer arm.

During payout of stock from the coil, the dancer arm must energize the reel drive motor in response to rising movement of the dancer arm indicating a decrease in the size of stock loop. Conversely, during rewind of stock, it is necessary to operate the reel drive motor in response to falling movement of the dancer arm which indicates an increase in the size of the stock loop. Cam lobe 56*a* is arranged to actuate the dancer arm switch 51 from its first condition engaging contact 51*a* to its second condition engaging contact 51*b*, in response to rising movement of the dancer arm when the dancer arm is at one side of the stock reel, and cam lobe 56*b* is arranged to actuate the dancer arm switch from its first condition to its second condition in response to rising movement of the dancer arm, when the dancer arm is at the other side of the stock reel. When the payout-rewind switch 53 is positioned as shown in FIG. 9 in its payout or P position, engaging contact 53*b*, dancer arm switch contact 51*b* is connected in a circuit with the speed control potentiometer 46 so that an input signal will be applied from the potentiometer to input terminal 35*b* when the dancer arm switch is moved into engagement with contact 51*b*. Conversely, when the dancer arm is at one side of the stock reel, lobe 56*a* will allow the dancer arm switch to move from its second condition engaging contact 51*b* to its first condition engaging contact 51*a* in response to falling movement of the dancer arm and, similarly, lobe 56*b* will operate the dancer arm switch from its second to its first condition in response to falling movement of the dancer arm when the dancer arm is at the other side of the stock reel. Thus, when the payout-rewind switch 53 is in its rewind position R engaging contact 53*a*, the dancer arm cam will operate to energize the rewind motor in response to falling movement of the dancer arm, when the dancer arm is at either side of the stock reel.

As previously described, the speed control potentiometer 46 is adjustable to vary the amplitude of the input signal applied to input terminal 35*b* and the motor control unit 30 is arranged to produce an output voltage at its output terminals 34*a*, 34*b* correlative in amplitude with the amplitude of the input signal. The direction of rotation of the reel must be changed dependent on whether the reel is in its payout or rewind mode, and also dependent on whether the reel is winding or unwinding stock from the top or the bottom of the coil. The reversing switch 40 is selectively operable to reverse the polarity of the voltage applied to the armature of the motor, to thereby reverse the direction of rotation. As also previously described, motor control units 31 are also available with a motor acceleration control circuit having an adjustable potentiometer 39 which can be utilized to adjust the rate of increase of the output signal applied to terminals 34*a* and 34*b*, when the input signal is changed, to thereby adjust the rate of acceleration of the reel drive motor.

The embodiments of the invention in which an exclusive property or privilege is claimed are defined as follows:

1. A stock reel comprising, a reel support, stock reel means for mounting a coil of stock on the reel support for rotation about a generally horizontal axis, an electric reel drive motor for driving the stock reel, a dancer arm mounted on the reel support for swinging movement about a generally horizontal dancer arm axis, the dancer arm being adapted to engage a loop of stock extending from the stock coil to be angularly displaced thereby through a range of dancer arm positions as the loop of stock increases and decreases, motor control means connected to said reel drive motor and having an input signal controller, said motor control means being operated to actuate the reel drive motor in response to a preselected input signal from the input controller, rotary actuator means for said input signal controller operative to control the input signal produced by the input controller in accordance with the relative angular position of the input controller and the rotary actuator means, means mounting said rotary actuator means for turning with said dancer arm about the dancer arm axis through said range of dancer arm positions, means mounting said input signal controller on said reel support for angular adjustment relative to the reel support about the dancer arm axis to vary the angular position of the dancer arm at which said input signal controller produces said preselected input signal.

2. A stock reel comprising a reel support, stock reel means for mounting a coil of stock on the support for rotation about a generally horizontal axis, an electric drive motor for driving the stock reel, a dancer arm mounted on the reel support for swinging movement about a generally horizontal dancer arm axis, the dancer arm being adapted to engage a loop of stock extending from the stock coil to be angularly displaced thereby through a range of dancer arm positions as the loop of stock increases and decreases, dancer arm switch means operative from a first condition to a second condition, a rotary actuator mounted for turning with the dancer arm about the dancer arm axis through said range of dancer arm positions, said rotary actuator being arranged to operate the dancer arm switch means between its first condition and its second condition at a preselected angular position of the actuator relative to the dancer arm switch means, means mounting the dancer arm switch means for angular adjustment relative to the reel support about the dancer arm axis to change the dancer arm position at which the actuator actuates the dancer arm switch means, and motor control means connected to the reel drive motor and to said dancer arm switch means for actuating the reel drive motor to drive the reel when the dancer arm switch means is in one of said conditions.

3. A stock reel according to claim 2 including visual indicator means angularly adjustable with said dancer arm switch means for indicating the dancer arm position at which the rotary actuator actuates the dancer arm switch.

4. A stock reel according to claim 2 wherein the dancer arm is selectively positionable to engage stock extending from either a first side or a second side of the stock reel means, a first visual indicator means angularly adjustable with said dancer arm switch means for indicating the angular position of the dancer arm at which the rotary actuator actuates the switch means when the dancer arm extends from said first side of the stock reel means, and a second visual indicator means angularly adjustable with the dancer arm switch means for indicating angular position of the dancer arm at which the rotary actuator actuates the switch means when the dancer arm extends from said second side of the stock reel means.

5. A stock reel according to claim 4 wherein said reel support includes a housing having a fixed wall extending generally radially of the dancer arm axis, a plate mounted adjacent the inner side of the fixed wall for angular adjustment with the dancer arm switch means about the dancer arm axis, said first and second visual indicator means being on said plate, said fixed wall of the housing having first and second view opening means therein arranged to enable visual observation of the respective first and second visual indicator means from a location outside the housing.

6. A stock reel according to claim 2 wherein said rotary actuator comprises a cam having first and second lobes, said first lobe being arranged to actuate said dancer arm switch means from its first to its second positions when the dancer arm moves through a preselected range of positions at the first side of the stock coil and said second lobe being arranged to actuate said dancer arm switch means from its first to its second condition when the dancer arm moves through a preselected range of conditions at the second side of the stock coil.

7. A stock reel comprising a reel support, stock reel means for mounting a coil of stock on the reel support for rotation about a generally horizontal axis, an electric drive motor for driving the stock reel, a dancer arm mounted on the reel support for swinging movement about a generally horizontal dancer arm axis, the dancer arm being positionable to engage stock extending from a first side of the stock reel means to be angularly displaced thereby through a first range of dancer arm positions as the loop of stock increases and decreases, the dancer arm being positionable to engage stock extending from a second side of the stock reel means to be angularly displaced thereby through a second range of dancer arm positions as the loop of stock increases and decreases, a rotary actuator mounted for turning with the dancer arm about the dancer arm axis, said rotary actuator being arranged to operate the dancer arm switch means between first and second conditions at a preselected angular position of the actuator relative to the dancer arm switch means, switch mounting means mounting the dancer arm switch means for angular adjustment relative to the reel support about the dancer arm axis, said switch mounting means being angularly adjustable through a first range of switch positions to change the angular position of the dancer arm at which the actuator operates the dancer arm switch means as the dancer arm moves in said first range of dancer arm positions, said switch mounting means being angularly adjustable through a second range of switch positions to change the angular position of the dancer arm at which the actuator operates the dancer arm switch means as the dancer arm moves in its second range of dancer arm positions, and motor control means connected to said reel drive motor and to said dancer arm switch means for actuating the reel drive motor to drive the reel when the dancer arm switch means is operated to a selected one of said conditions.

8. A stock reel according to claim 7 including first and second visual indicator means mounted for angular adjustment with the switch mounting means for indicating the angular position at which the rotary actuator operates the dancer arm switch means when the dancer arm is respectively at said first and said second side of the stock reel.

9. A stock reel according to claim 7 wherein said rotary actuator has a first means for actuating said dancer arm switch means from its first to its second condition in response to turning of the rotary actuator in one direction through a first preselected angular position of the actuator relative to the dancer arm switch means when the dancer arm is positioned to engage stock at said first side of the stock coil, said rotary actuator having second means for actuating said dancer arm switch means from its first to its second condition in response to turning of the rotary actuator in the opposite direction past a second preselected angular position of the rotary actuator relative to the dancer arm switch means when the dancer arm switch is positioned to engage stock at said second side of the stock coil.

10. A stock reel according to claim 9 including a selectively operable switch means connected to said dancer arm switch means and movable between a first and a second position, said selectively operable switch means being operative in its first position to condition the dancer arm switch means to control actuating of the drive motor when the dancer arm switch means is moved to its first condition and operative in its second position to condition the dancer arm switch means to control actuation of the drive motor when the dancer arm switch means is moved to its second condition.

11. A stock reel according to claim 10 wherein said motor control means includes selectively operable motor reversing switch means for reversing the direction of rotation of the motor when it is actuated.

* * * * *